United States Patent [19]

Isa et al.

[11] 4,029,606

[45] June 14, 1977

[54] NON-LIQUID DETERGENT COMPOSITION

[75] Inventors: Hiroshi Isa, Yachiyo; Noboru Suzuki, Kawasaki; Masatoshi Takahashi, Fujisawa; Eriko Hirayama, Ichikawa, all of Japan

[73] Assignee: Lion Fat & Oil Co., Ltd., Tokyo, Japan

[22] Filed: May 9, 1975

[21] Appl. No.: 576,164

[30] Foreign Application Priority Data

Dec. 5, 1974 Japan ..... 49-139745

[52] U.S. Cl. ..... 252/529; 252/89 R; 252/135

[51] Int. Cl.[2] ..... C11D 1/08

[58] Field of Search ..... 252/89, 135, 529; 260/484 A, 488 R, 410.9 R

[56] References Cited

UNITED STATES PATENTS

| | | | |
|---|---|---|---|
| 2,183,853 | 12/1939 | Haussmann et al. | 260/404 |
| 2,733,252 | 1/1956 | Thompson et al. | 260/410.9 R |
| 2,789,992 | 4/1957 | Thompson et al. | 260/410.9 R |
| 3,332,880 | 7/1967 | Kessler et al. | 252/555 |
| 3,728,447 | 4/1973 | Osipow et al. | 252/545 X |

*Primary Examiner*—Harris A. Pitlick
*Attorney, Agent, or Firm*—Woodhams, Blanchard and Flynn

[57] ABSTRACT

A non-liquid detergent composition prepared by shaping a detergent composition comprising an acyl-polyhydroxy carboxylate having the formula $$\left[ RCO \left( \overset{R'}{\underset{}{OCHCO}} \right)_n O \right]_m M$$

(wherein R represents a saturated or unsaturated straight-chain or branched-chain hydrocarbon group having 5 to 19 carbon atoms, R′ represents H, $CH_3$ or $C_2H_5$, *n* is an integer of 1 or more, *m* is an integer ranging from 1 to 2, and M represents monovalent or divalent cation).

13 Claims, 1 Drawing Figure

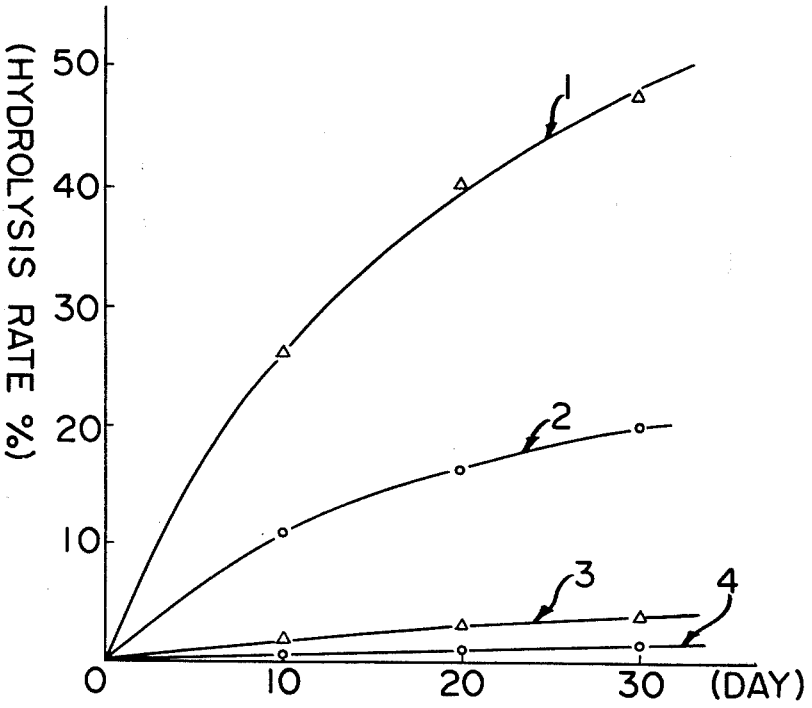
(HYDROLYSIS RATE %)
50
40
30
20
10
0
10
20
30
(DAY)
1
2
3
4

NON-LIQUID DETERGENT COMPOSITION

BACKGROUND OF THE INVENTION

1. Field of the Invention

The present invention relates to a novel non-liquid detergent composition which displays an excellent detergency even in hard water, as well as soft water, and an excellent stabilty during prolonged storage.

2. Description of the Prior Art

Acyl-poly-hydroxy carboxylic acid is popular as an emulsifier for use in baking particular in the case of applying lactic acid. Besides, according to U.S. Pat. No. 3,728,447, the sodium salt of acyl-poly-hydroxy carboxylic acid is utilized for hair-conditioning and can improve the manageability thereof.

However, it has not been known to date that acyl-poly-hydroxy carboxylic acid has such characteristics that it can display a superior detergency only when a polyvalent metal ion, particularly a divalent metal ion, coexists therewith, and it gets hydrolyzed when left standing for a long time at a high temperature in the presence of water and the detergency thereof lowers remarkably.

SUMMARY OF THE INVENTION

The present invention provides a non-liquid detergent composition, which checks the decomposition of acyl-polyhydroxy carboxylate as far as possible. It displays an excellent stability during prolonged storage and an excellent detergency even in hard water, as well as soft water. The non-liquid detergent compositions is prepared by shaping a detergent composition comprising an acyl-poly-hydroxy carboxylate having the formula $$\left[ RCO \left( \overset{R'}{\overset{|}{OCHCO}} \right)_n O \right]_m M$$

(wherein R represents saturated or unsaturated staight-chain or branched-chain hydrocarbon having 5 to 19 carbon atoms, R′ represents H, $CH_3$ or $C_2H_5$, $n$ is an integer of 1 or more, $m$ is an integer ranging from 1 to 2, and M represents monovalent or divalent cation) and preferably having less than 0.8 moles of water per ester linkage.

BRIEF DESCRIPTION OF THE DRAWING

The appended drawing is a graph illustrating the stability of the composition according to the present invention against free water with the passage of time (days).

DETAILED DESCRIPTION OF THE INVENTION

As the starting material fatty acid for use in preparing an acyl-poly-hydroxy carboxylic acid to be employed in the non-liquid detergent composition in the present invention and expressed by the foregoing general formula, saturated or unsaturated straight-chain or branched-chain fatty acids having 6 to 20 carbon atoms are employed. Said fatty acids include fatty acids obtained from natural fats, fatty acids manufactured from olefins and carbon monoxide by oxo synthesis or the like, fatty acids manufactured by oxidation of paraffins, etc. In the case of fatty acids having 6 to 10 carbon atoms and 16 to 20 carbon atoms, it is appropriate to employ them independently as the detergency thereof is relatively minor, but it will do to employ them upon admixing with fatty acids having 11 to 15 carbon atoms. On the occasion of thus admixing, it is desirable that the ratio of said fatty acid having 11 to 15 carbon atoms is more than 70 wt. %. As the fatty acids for this purpose, there are, for instance, caproic acid, caprylic acid, lauric acid, myristic acid, palmitic acid, stearic acid, arachidic acid, oleic acid, α-methyl decanoic acid, α-methyl dodecanoic acid, α-methyl tridecanoic acid, α-methyl tetradecanoic acid, etc.

α-hydroxy crboxylic acid as another constituent of acyl-poly-hydroxy carboxylic acid includes glycolic acid, lactic acid and α-hydroxy butyric acid. The degree of condensation $n$ of α-hydroxy carboxylic acid has a grave influence upon the detergency; when $n$ ranges from 2 to 4, the highest detergency is displayed, and as $n$ becomes bigger, the detergency lowers gradually. Therefore, in the case of applying an acyl-polyhydroxy carboxylic acid independently, it is appropriate to make $n$ in the range of from 2 to 6, while in the case of applying it as a mixture, it is appropriate to make $n$ be in the range of from 1.7 to 6.5 on the average, and particularly in order to obtain the highest detergency, $n$ is to be in the range of from 1.7 to 4.5. Preferably when $n$ is in the range of from 2 to 6 the content of the fatty acid is more than 50 wt. %. When $n$ is 1, even in the case of applying a divalent metal salt, the detergency is inferior, so that it cannot be applied independently, but it may be applied upon admixing more than two varieties.

These acyl-poly-hydroxy carboxylic acids display an excellent detergency when they coexist with divalent metal ion within a detergent solution, but in the absence of the divalent metal ion, the detergency thereof is inferior. It is considered that the acyl-poly-hydroxy carboxylic acid forms a salt which is undissociated or partially dissociated from the divalent metal ion within the detergent aqueous solution and said salt displays an excellent detergency. Accordingly, in the case where a divalent metal ion is present in the detergent aqueous solution, there is no necessity for making the detergent composition contain the divalent metal ion previously. The divalent metal ion includes ion of alkaline earth metal such as calcium, magnesium, barium, etc. and cobalt ion. Further, the acyl-poly-hydroxy carboxylic acid is used as a salt of an alkali metal such as sodium and potassium or triethanol amine in addition to the foregoing divalent metal ion. By making a portion of the cyl-poly-hydroxy carboxylic acid applied into a divalent metal salt and the remainder thereof into an alkali metal salt, its solubility in cold water and the fluidity of the granular detergent made of it can be improved.

The appropriate amount of acyl-poly-hydroxy carboxylate to be applied is in the range of from 5 to 80 wt.%, preferably from 10 to 60 wt.%. Especially in the case where it is independently applied as an ingredient of surface active agent, it is preferable to be more than 20 wt.%.

The acyl-poly-hydroxy carboxylate according to the present invention is in the state of a paste or semi-solid, not in the state of dry powder or granule, at room temperature, and it tends to agglomerate easily. Therefore, in order to shape it into a desired configuration, it is necessary to use some shaping agent. Since the acyl-poly-hydroxy carboxylic acid has strong acidity and strong alkalinity and is instable, and besides, it displays detergency when the pH value of the detergent aqueous solution is more than 6, as the shaping agent for this purpose, an organic or inorganic water-soluble salt having a pH value in the range of from 4 to 11 (1% aqueous solution), preferably from 6 to 11 (1% aqueous solution), is appropriate. To cite compounds suitable for this purpose, there are such inorganic salts as sodium sulfate, sodium carbonate, sodium bicarbonate, sodium chloride, sodium phosphate, sodium tripolyphosphate, sodium borate, potassium carbonate, magnesium sulfate, calcium chloride, etc. and such organic salts as sodium citrate, sodium tartrate, sodium malate, sodium succinate, sodium sulfosuccinate, sodium lactate, sodium glycolate, potassium citrate, potassium lactate, calcium citrate, calcium lactate, etc. Preferable shaping agent is a substance capable of buffer action to control the change of pH value within the range of from 6.0 to 8.2 or capable of alkali builder action to contribute to the promotion of detergency, or a water-soluble inorganic neutral salt. Preferable substance capable of buffer action is an alkali salt of a weak acid. The appropriate amount of these shaping agents to be applied is in the range of from 5 to 95 wt.%, preferably from 30 to 80 wt.%, from the viewpoint of the detergency and the fluidity of granular detergent. The shaping agent for use in the present invention is supposed to be a substance capable of displaying at least the buffer action among the 3 functions to be displayed by the so-called 'builder' (namely, buffer action, high alkalinity and chelating action) or an inorganic neutral salt, preferably a substance capable of displaying buffer action and high alkalinity or an inorganic neutral salt. Further, it is possible to apply said shaping agent upon replacing a portion thereof with a water-soluble macromolecular substance such as carboxymethyl cellulose and water-soluble starch, a water-insoluble inorganic powder such as white carbon, and the like.

In the powdery or granular detergent composite according to the present invention, the content of free water per mole of ester linkage of acyl-poly-hydroxy carboxylic acid is desirably less than 0.8 mole. Provided that the molar ratio is less than 0.8, even when a portion of the ester linkage of the acyl-poly-hydroxy carboxylic acid is hydrolyzed, the hydrolysis will no longer progress after the content of free water has decreased to the water content at equilibrium. Therefore, by selecting the degree of condensation $n$ properly, the influence of free water upon the detergency can be extremely minimized. The preferably content of free water per mole of ester linkage is less than 0.5 mole, and in this case, the detergency will not be affected even when hydrolysis takes place due to free water.

The powdery or granular detergent composition or the powder or granular active ingredient according to the present invention is prepared in the form of a powder or granules through the spray drying process, granulation process, etc. For instance, an aqueous slurry comprising acyl-poly-hydroxy carboxylate and shaping agent is subjected to spray drying under such a condition that the content of free water not fixed as water of crystallization at room temperature is less than 0.8 mole per mole of ester linkage. Alternatively, a mixture of slurry-like acyl-poly-hydroxy carboxylate with minor fluidity containing excessive water which is slightly more than the amount to be fixed as water of crystallization and the shaping agent is subjected to thorough mixing or kneading and is thereafter made into a powdery or granular product containing free water less than the prescribed amount through the crushing granulation process, rolling granulation process or the like.

A preferable method of preparing the non-liquid detergent composition according to the present invention is a method comprising mixing the aforesaid mixture of acyl-poly-hydroxy carboxylate and shaping agent as the powdery or granular active ingredient with a powdery or granular anhydrous calcium chloride constituting a detergency imparting ingredient and being capable of fixing free water and moisture within the atmosphere as the water of crystallization in the form of powder or granule.

On this occasion, it is more preferable to employ a monovalent salt such as the aforesaid alkali metal salt or ammonium salt which is superior to the divalent metal salt in water solubility as the acyl-poly-hydroxy carboxylate and employ an almost neutral alkali metal salt as the principal ingredient of the shaping agent. The merit of mixing these ingredients in the form of powder or granule lies in that: hydrolysis or acyl-poly-hydroxy carboxylic acid can be checked to the highest degree as the anhydrous calcium chloride added in the form of powder or granule absorbs the moisture in the atmosphere; through the amount of alkaline compound to be applied is restricted as the pH value of the aqueous slurry cannot be raised very high, as long as it can be added separately in the form of powder or granule, the amount to be added can be changed at will; as it is not necessary to use acyl-poly-hydroxy carboxylic acid in the state of divalent metal salt, there can be obtained a powdery or granular detergent composite which can be very easily dissolved in water; and so on. It of course will do to apply the divalent metal salt of acyl-poly-hydroxy carboxylic acid. Further, as to the amount of anhydrous calcium chloride to be applied separately from the detergent active ingredient containing acyl-poly-hydroxy carboxylate, though it varies with the amount of divalent metal ion contained in said detergent active ingredient, it is appropriate to be in the range of from 5 to 30 wt.%. Besides, said anhydrous calcium chloride can be applied as a powdery or granular composition containing other optional ingredients such as sodium carbonate, carboxymethyl cellulose, etc.

The non-liquid detergent composition according to the present invention may be used by shaping it into tablets or putting it in capsules thereby further decreasing the influence of moisture in the atmosphere, in addition to the direct use in the form of powder or granule.

The non-liquid detergent composition prepared as above displays an excellent detergency particularly in hard water, so that it is not necessary to employ any metallic chelating agent for the purpose of blocking polyvalent metal ion, such as condensed phosphate, nitrilotriacetate, etc. Moreover, the present composition is readily biodecomposed under natural conditions when it is discharged after use in cleansing, so that it scarcely causes water pollution. Besides, despite the fact that it contains acyl-poly-hydroxy carboxylate which is vulnerable to hydrolysis, it is superior in stability during prolonged storage. Especially in the case where acyl-poly-lactic acid is applied as acyl-poly-hydroxy carboxylic acid, the present detergent composition is very safe to the human body, and has a merit that irritation of the eye or skin is minimized.

In the non-liquid detergent composition according to the present invention, the surface active agent for use in conventional detergents, builders having no shaping effect such as alkali silicate, foam stabilizer, foam controlling agent, fluorescent brightening agent, bleaching agent, germicide, perfume, coloring matter, etc. can be applied. Moreover, it can be used not only domestically but also industrially; that is, it is useful for washing clothes, woolen yarn, tableware and vegetables, for the automatic dish-washing machines, and as detergents for homes as well as various industrial uses, and in addition thereto, it can be utilized for shampoos.

An example of the effect of the present invention is here-under given by reference to the appended drawing. This drawing is a graph, illustrating the stability of a detergent prepared through the spray drying process against free water with the passage of time (days). Samples (1) - (4) were preserved in a closed receptacle at a temperature of 50° C, and the ratio of hydrolysis 10 days after, 20 days after and 30 days after were respectively measured. In this connection, the composition of the respective samples were as follows:

Composition of sample (weight ratio):

1. luuryl-poly-sodium lactate($n$=3.4)/sodium sulfate=¼; 2.0% of free water (number of moles of $H_2O$ per ester linkage: 0.78 mole).
2. lauryl-poly-sodium lactate($n$=3.4)/sodium sulfate=¼; 1.1% of free water (number of moles of $H_2O$ per ester linkage: 0.42 mole).
3. 5 wt.% of calcium chloride was further added to the sample (2); 1.0% of free water (number of moles of $H_2O$ per ester linkage: 0.42 mole).
4. 20 wt.% of calcium chloride was further added to the sample (b 2); 0.9% of free water (number of moles of $H_2O$ per ester linkage: 0.41 mole).

As will be understood from the appended drawing, in the case of comosition (1) containing almost the critical amount of free water, the ratio of hydrolysis 30 days after was fairly high and accordingly the detergency lowered in some degree, while, as seen in the case of the compositions (2), (3) and (4), the lower the content of free water, the lower is the ratio of hydrolysis, and the lowering of detergency was remarkably improved accordingly.

DESCRIPTION OF THE PREFERRED EMBODIMENTS

Hereunder will be given some examples of embodiments of the present invention. The tests in these embodiments for the purpose of comparing the detergency were conducted by applying the following methods.

I. Detergency test A

A fat prepared by mixing beef tallow with soybean oil at the weight ratio of 1:1 is stuck to each glass slide as soil to the extent of 120 – 130 mg. A 6-piece set of said glass slide are fixed on a holder and cleansed in 700 ml of a solution having detergent concentration of 0.05% and a temperature of 25° C by stirring said solution with a motor driven at a fixed speed of 250 r.p.m. from the central part of the holder. The detergency is expressed in terms of the ratio of removal of the adhereing soil as determined from the weight of glass slides before and after cleansing.

II. Detergency test B

Be employing an artificially soiled test cloth, the detergency is measured through the following process. First, organic soil ingredients as follows are mixed by heating at a temperature in the range of from 60° to 80° C, the resulting mixture is left standing at room temperature to cool, clay as an inorganic soil ingredient is added to the thus cooled mixture, and the mixture is further mixed in a mortar.

| | |
|---|---|
| organic soil | myristic acid<br>oleic acid<br>tristearin<br>triolein<br>cholesterol<br>cholesterol stearate<br>paraffin wax<br>squalene |
| inorganic soil | clay: 'Shimosueyoshi' loam is dried at 800° C for 3 hours, crushed thereafter, and passed 325-mesh sieve. |
| organic soil/inorganic soil/carbon black | 49.75/49.75/0.5 |

The soil put on a sponge in a small amount at a time is applied uniformly on a No. 60-count cotton broadcloth (manufactured by KANEBO K.K. and having starch and fluorescent brightening agent removed) to soil it to the extent that it exhibited a photoelectric reflectance of 42±2% as measured with Elrepho manufactured by Carl Zeiss Co., and the thus soiled cloth is further rubbed with a clean sponge. By cutting this soiled cloth into pieces of 5 cm × 5 cm, test cloths are prepared. 10 pieces of said test cloths are subjected to 10 minutes' cleansing in a detergent solution of 900 cc having a temperature of 25° C by the use of Terg-O-Tometer (the manufacture of Testing Co., U.S.A.) at loading ratio of 30 and at 150 r.p.m. For the purpose of balancing the loading ratio, test cloths smeared with 0.6% or organic ingredients of artificial soil are employed. Rinsing is conducted for 3 minutes under the same conditions as in the case of cleansing. The ratio of detergence is calculated by applying the following formula upon measuring the reflectance of soiled cloth before and after cleansing.

$$\text{ratio of detergence}(\%) = \frac{Rw - Rs}{Ro - Rs} \times 100$$

(wherein: Ro represents reflectance(%) of clean cloth
Rs represents reflectance(%) of soiled cloth before cleansing
Rw represents reflectance of soiled cloth after cleansing)

EXAMPLES 1 – 4.

A mixture consisting of lauric acid (1050 g), 75% lactic acid (1890 g) and phosphoric acid (60 g) placed in a 4-nozzled flask having a capacity of 5 l was subjected to 3 to 4 hours' stirring at a temperature in the range of from 170° to 180° C in the presence of $N_2$ vapor current, whereby water was removed. Subsequently, after reducing the pressure within the flask to be in the range of from 40 to 60 mmHg, by subjecting the mixture to 6 hours' stirring at the same temperature as above, the esterification reaction thereof was completed.

After completion of the reaction, the content of the flask was dissolved in diethyl ether, and then washed with water, whereby phosphoric acid and poly-lactic acid were removed. Subsequently, unreacted lauric acid was subjected to fractional distillation under reduced pressure and thereafter subjected to molecular distillation, whereby lauryl-poly-lactic acid having the following composition was obtained.

Table-1

| $C_{11}H_{23}CO(O\underset{\underset{CH_3}{\vert}}{C}HCO)_nOH$ | | |
|---|---|---|
| n=1 | 11.4 | wt.% |
| 2 | 37.0 | " |
| 3 | 34.8 | " |
| 4 | 11.9 | " |
| 5 | 3.8 | " |
| 6 | 1.2 | " |

By the use of this lauryl-poly-lactic acid, test was conducted of the dryness, fluidity and detergency of a powder obtained by subjecting 50 wt.% slurry prepared from a compound admixed with the following buffer agent to spray-drying within a hot blast having a temperature of 300° C by means of a rotary disc-type atomizer.

Table-2

| | Example 1 | 2 | 3 | 4 |
|---|---|---|---|---|
| lauryl-poly-sodium lactate | 30 wt.% | 30 wt.% | 30 wt.% | 30 wt.% |
| $Na_2HPO_4/KHPO_4$ (wt. ratio) = 4.2 | — | 5 " | — | — |
| lactic acid/$NaHCO_3$ (wt. ratio) = 0.17 | — | — | 5 " | — |
| malic acid/$NaHCO_3$ (wt. ratio) = 0.13 | — | — | — | 5 " |
| magnesium sulfate | — | 5 " | 5 " | 5 " |
| sodium sulfate | 60 " | 50 " | 50 " | 50 " |
| water | 10 " | 10 " | 10 " | 10 " |
| condition during the spraying | all satisfactory; a dry powder could be obtained | | | |
| free water (%) | 8.5 | 8.3 | 8.5 | 7.2 |

Test of the fluidity was conducted in the following way.

a. Adjustment of the sample for measurement

A weathering room (a thermo-hygrostatic chamber, provided with a forced circulating apparatus) was adjusted to have a temperature of 35° C and 85%RH, and a sample contained in a closed carton made of an incomplete damp-proof paper (with one-time overprint) was left standing in the atmosphere thereof for 24 hours.

b. Measurement of the fluidity

By tilting the carton containing the adjusted sample, the content was let to fall naturally or flow down by giving a slight impact from the outlet provided on the top of the carton, and the condition of effluence was observed.

Valuation

| Examination marks | Condition of effluence |
|---|---|
| effluence by natural falling | 10 flows out fluently without any hitch at all.<br>9 flows out fluently but the effluence is discontinued 2 – 3 times.<br>6 flows out intermittently.<br>5 does not flow out, but when impact is given one time, effluence begins and continues naturally until the whole amount flows out. |

-continued

| Examination marks | Condition of effluence |
|---|---|
| effluence by falling under slight impact | 4 the frequency of impact necessary for making the whole amount flow out 2 – 3 times<br>3 the frequency of impact necessary for making the whole amount flow out 4 – 5 times<br>2 the frequency of impact necessary for making the whole amount flow out 6 – 8 times<br>1 the frequency of impact necessary for making the whole amount flow out 9 – 10 times<br>0 does not flow out even when impact is given 10 times. |

The result of test of the fluidity was follows:

Table-3

| | | Examination marks | Detergency test A* |
|---|---|---|---|
| Example | 1 | 4 | 72 |
| | 2 | 7 | 83 |
| | 3 | 7 | 86 |
| | 4 | 6 | 86 |

*0.20%, CaO 3° dH

Next, after preparing 0.20% aqueous solution of the dry powder obtained in Example 3, the detergency of said aqueous solution was measured by detergency test A and B.

Table-4

| CaO hardness | Detergency as measured by detergency test B | as measured by detergency test A |
|---|---|---|
| 1 | 68 | 60 |
| 3 | 90 | 86 |
| 5 | 93 | 87 |
| 10 | 92 | 87 |
| 30 | 90 | 85 |

Ester salt of lauryl-poly-lactic acid has proved capable of displaying an excellent detergency with respect to various soils and maintaining an excellent detergency even in water of high hardness.

EXAMPLES 5 – 6.

By employing glycolic acid in lieu of lactic acid used in Examples 1 – 4 in the esterification reaction, and thereafter applying the same procedures for after-treatment as in Examples 1 – 4, a lauryl-poly-glycolic acid having the following composition was obtained.

Table-5

| $C_{11}H_{23}CO(OCH_2CO)_nOH$ | | |
|---|---|---|
| n=1 | 5.2 | wt.% |
| 2 | 43.1 | " |
| 3 | 30.0 | " |
| 4 | 12.7 | " |
| 5 | 4.2 | " |
| 6 | 2.6 | " |
| 7 | 2.2 | " |

By employing this lauryl-poly-glycolic acid and applying the same procedures as in Examples 1 – 4, a dry powder having the following composition was obtained.

Table-6

| | Example 5 | Example 6 |
|---|---|---|
| lauryl-poly-sodium glycolate | 30 wt.% | 30 wt.% |
| sodium glycolate/$NaHCO_3$ (wt.ratio) = 0.17 | 5 " | 5 " |
| magnesium sulfate | 5 " | — |
| calcium chloride | — | 5 " |
| Glauber's salt | 50 " | 50 " |
| water | 10 " | 10 " |

The condition at the time of spraying was satisfactory both in Example 5 and Example 6, and the content of free water in the drier was 8.2% in both cases. The examination mark with respect to the fluidity was 7 in both cases.

EXAMPLE 7.

By the use of lauryl-poly-lactic acid ester having a mean condensation number of lactic acid of 2.8, varieties of powdery mixtures having the following composition respectively were obtained. The detergency of the respective mixtures was measured by detergency test B (0.167%, 3°dH CaO).

Table-7

| | I | II | III | IV |
|---|---|---|---|---|
| lauryl-poly-sodium lactate | 30 wt.% | 30 wt.% | 30 wt.% | 30 wt.% |
| sodium carbonate | 0 " | 10 " | 30 " | 50 " |
| carboxymethyl cellulose | 1 " | 1 " | 1 " | 1 " |
| magnesium sulfate | 3 " | 3 " | 3 " | 3 " |
| water | 10 " | 10 " | 10 " | 10 " |
| sodium sulfate | balance | balance | balance | balance |
| detergency | 56 | 88 | 95 | 93 |

EXAMPLES 8 – 10.

The detergency was measured in the case of employing the lauryl-poly-lactic acid of Example 7 and applying various builders in the following composition by the detergency test B under the same conditions as in Example 7.

| Composition: | |
|---|---|
| lauryl-poly-sodium lactate | 30 wt.% |
| alkali builder | 30 " |
| magnesium sulfate | 3 " |
| carboxymethyl cellulose | 1 " |
| water | 10 " |
| sodium sulfate | balance |

Table-8

| Example | Alkali builder | Detergency |
|---|---|---|
| 8 | sodium bicarbonate | 91 |
| 9 | sodium tripolyphosphate | 96 |
| 10 | sodium lactate | 91 |

The test of detergency in from Example 11 onward was conducted by the detergency test A.

EXAMPLE 11.

5 varieties of samples different in the content of free water was prepared by subjecting a detergent slurry with 40 wt.% concentration of a solid containing 30 parts by weight of lauryl-poly-sodium lactate (mean concentration number $n$ of lactic acid = 2.7), 15 parts by weight of calcium chloride, 1 part by weight of sodium carbonate and 54 parts by weight of sodium sulfate to spray-drying by modifying the speed of supply and the temperature of hot blast. Subsequently, by putting each sample in a closed receptacle and storing it at a temperature of 50° C for 30 days, the stability against hydrolysis and the detergency with the passage of time were measured. The result was as shown in Table-9 in the following.

EXAMPLE 12.

2 varieties of samples were prepared through the same procedures as in Example 11 by the use of lauryl-poly-sodium glycolate (mean condensation number $n$ of glycolic acid=2.2) and magnesium sulfate in lieu of lauryl-poly-sodium lactate and sodium sulfate used in Example 11. The result of measurement conducted in the same way as in Example 11 was as shown in the following Table-9.

Table-9

Influence of Water upon Preservation Stability

| Item of measurement | Number of days elapsed (at 50° C) | Example 11 I | 11 II | 11 III | 11 IV | 11 V | 12 I' | 12 II' |
|---|---|---|---|---|---|---|---|---|
| | | Temperature for drying (° C) | | | | | | |
| | | 230 | 230 | 300 | 300 | —[1] | 300 | —[1] |
| | | Molecular number of $H_2O$ per ester linkage | | | | | | |
| | | 1.43 | 0.73 | 0.38 | 0.182 | 0.088 | 0.242 | 0.123 |
| ratio of[2] hydrolysis (%) | at the start | 0 | 0 | 0 | 0 | 0 | 0 | 0 |
| | 10 days | 58 | 23 | 12 | 4 | 0 | 2 | 0 |
| | 30 days | 98 | 49 | 20 | 9 | 2 | 6 | 3 |
| detergency[3] | at the start | 86 | 85 | 85 | 85 | 83 | 87 | 87 |
| | 30 days | 1 | 79 | 84 | 85 | 84 | 86 | 87 |

[1]Samples was prepared respectively from samples IV and I' vacuum drying.
[2]Ratio of hydrolysis was shown by applying the following formula:

$$\left(\frac{\text{neutralization value after the passage of time}}{\text{ester value at the start of leaving the sample standing}}\right) \times 100,$$

wherein ratio of hydrolysis at the start was regarded to be 0.
[3]Detergent concentration: 0.15%, hardness (CaO) 3° dH

EXAMPLE 13.

Varieties of samples were prepared by subjecting a detergent slurry with 40 wt.% concentration of a solid having the following composition containing lauryl-poly-sodium lactate (mean condensation number $n$ of lactic acid = 3.2) to spray-drying by applying a hot blast having a temperature of 230° C and 300° C, respectively. The result of measurement of properties of these samples was as shown in the following Table-10.

Table-10

| Ingredients | A | B |
|---|---|---|
| lauryl-poly-sodium lactate | 30 wt.% | 30 wt.% |
| calcium chloride | — | 15 |
| sodium carbonate | — | 3 |
| sodium sulfate | 70 | 52 |

| | Sample Number | | | |
|---|---|---|---|---|
| | A | | B | |
| | I | II | I' | II' |
| | Temperature for drying (° C) | | | |
| Properties of dry sample | 230 | 300 | 230 | 300 |
| water (wt.%) | 1.7 | 2.0 | 1.7 | 1.6 |
| molecular number of $H_2O$ per ester linkage | 0.45 | 0.52 | 0.45 | 0.42 |
| bulk specific gravity | 0.22 | 0.23 | 0.23 | 0.20 |
| pH value | 7.5 | 7.2 | 7.6 | 7.1 |
| detergency (%)[1] | 84 | 85 | 84 | 82 |
| ratio of decomposition immediately[2] after drying (%) | 0 | 2 | 9 | 23 |
| ratio of decomposition 30 days after (%) | 21 | 26 | 38 | 51 |

[1]Concentration of detergent liquid: 0.15%, hardness of water (CaO): 20° dH as for A, 3° as for B.
[2]Ratio of decomposition was calculated in the same way as in example 12.

The showing in Table-10 verifies that, when the pH value of detergent slurry is high, the ratio of decomposition of ester linkage becomes high, and the speed of decomposition also becomes high as seen from the ratio of decomposition 30 days after. Accordingly, the detergency in likely to be influenced thereby, so that is is not preferable to mix an alkali buider simultaneously with an acyl-poly-hydroxy acid salt.

EXAMPLE 14.

2 varieties of compositions, one containing free water of 0.5 wt.% and the other containing free water of 2.3 wt.%, which consist of 37 parts by weight of lauryl-poly-sodium lactate ($n$=2.5) and 63 parts by weight of sodium sulfate were prepared by spray-drying method. Next, by compounding 100 parts by weight of the respective composition with 18 parts by weight of calcium chloride and 3.7 parts by weight of sodium bicarbonate in the form of powder, varieties of samples having the following compositions were prepared.

Upon putting each sample in a closed receptacle and storing at a temperature of 50° C for 30 days, the stability against hydrolysis and the detergency were measured. The result was as shown in Table-11 in the following.

| Composition | Sample A | B |
|---|---|---|
| lauryl-poly-sodium lactate | 30.3 wt.% | 29.7 wt.% |
| calcium chloride | 14.9 " | 14.9 " |
| sodium bicarbonate | 3.0 " | 3.0 " |
| water | 0.4 " | 1.9 " |
| sodium sulfate | balance | balance |

EXAMPLE 15.

A dry powder with free water of 0.5 wt.% consistng of 37 parts by weight of lauryl-poly-sodium glycolate ($n$=2.2) and 63 parts by weight of sodium sulfate was prepared by spray-drying method. Subsequently, by compounding 100 parts by weight of this dry powder with 18 parts by weight of anhydrous calcium chloride and 3.7 parts by weight of sodium carbonate in the form of powder, a sample was prepared. Next, upon putting this sample in a closed receptacle and preserving at a temperature of 50° C for 30 days, the stability against hydrolysis and the detergency were measured. The result was as shown in the following Table-11.

Table-11

| | | Example | | |
|---|---|---|---|---|
| | | 14 | | 15 |
| | | A | B | |
| | | Molecular number of $H_2O$ per ester linkage | | |
| Item of measurement | Number of days elapsed (at 50° C) | 0.12 | 0.57 | 0.12 |
| Stability against hydrolysis | 0 day | 0 | 0 | 0 |
| | 10 days | 0.4 | 1.0 | 0.9 |
| | 30 days | 1.1 | 2.5 | 2.8 |
| detergency | 30 days | 85 | 85 | 83 |

What is claimed is:

1. A solid detergent composition in the form of a powder, granules or tablets, consisting essentially of a mixture obtained by blending a. from 5 to 80 weight percent of organic surfactant substance having the formula $$\left[ RCO \left( \overset{\overset{R'}{|}}{OCHCO} \right)_n O \right]_m M$$

wherein R is saturated or unsaturated straight-chain or branched-chain hydrocarbon having 5 to 19 carbon atoms, with the proviso that more than 70 weight percent of R has from 10 to 14 carbon atoms, R' is hydrogen, $CH_3$ or $C_2H_5$, $n$ is a number in the range of 1.7 to 6.5 on the average, M is a monovalent or divalent cation, and $m$ is one or 2 depending on the valency of M, and b. from 5 to 95 weight percent of water-soluble organic or inorganic salt selected from the group consisting of sodium sulfate, sodium carbonate, sodium bicarbonate, sodium chloride, sodium phosphate, sodium tripolyphosphate, sodium borate, potassium carbonate, magnesium sulfate, sodium citrate, sodium tartrate, sodium malate, sodium succinate, sodium sulfosuccinate, sodium lactate, sodium glycolate, potassium citrate, potassium lactate, calcium citrate and calcium lactate, or mixtures thereof, with the proviso that one percent aqueous solutions of said salts have a pH of from 6 to 11, said composition additionally containing from 5 to 30 weight percent of anhydrous calcium chloride, said composition containing less than 0.8 mole of free water per mole of ester linkages in said organic surfactant substance.

2. A composition according to claim 1, containing from 10 to 60 weight of said organic surfactant substance and from 30 to 80 weight percent of said salts.

3. A composition according to claim 1 in which $n$ is from 1.7 to 4.5 on the average.

4. A composition according to claim 1, in which $n$ is from 2 to 4.

5. A composition according to claim 1 in which R is lauryl and R′ is $CH_3$.

6. A composition according to claim 1 in which R is lauryl and R′ is hydrogen.

7. A composition according to claim 1 in which more than 70 percent of said organic surfactant substance is present as the calcium salt.

8. A composition according to claim 1 in which M is selected from the group consisting of calcium, magnesium, barium, cobalt, sodium, potassium and triethanolamine.

9. A composition according to claim 1 containing less than 0.5 mole of free water per mole of ester linkages in said organic surfactant substance.

10. A composition according to claim 1 in which said salt is comprised predominantly of sodium sulfate.

11. A composition according to claim 1, also containing an alkali silicate.

12. A solid detergent composition in the form of a powder, granules or tablets, consisting essentially of:

a. from 5 to 80 weight percent of organic surfactant substance having the formula $$\left[ RCO \left( \begin{array}{c} R' \\ | \\ OCHCO \end{array} \right)_n O \right]_m M$$

wherein R is saturated or unsaturated straight-chain or branched-chain hydrocarbon having 5 to 19 carbon atoms, with the proviso that more than 70 weight percent of R has from 10 to 14 carbon atoms, R′ is hydrogen, $CH_3$ or $C_2H_5$, $n$ is a number in the range of 1.7 to 6.5 on the average, M is a monovalent or divalent cation, and $m$ is one or 2 depending on the valency of M, b. from 5 to 95 weight percent of water-soluble organic or inorganic salt selected from the group consisting of sodium sulfate, sodium carbonate, sodium bicarbonate, sodium chloride, sodium phosphate, sodium tripolyphosphate, sodium borate, potassium carbonate, magnesium sulfate, calcium chloride, sodium citrate, sodium tartrate, sodium malate, sodium succinate, sodium sulfosuccinate, sodium lactate, sodium glycolate, potassium citrate, potassium lactate, calcium citrate and calcium lactate, or mixtures thereof, with the proviso that one percent aqueous solutions of said salts have a pH of from 6 to 11 and with the further proviso that component (b) is comprised predominantly of sodium sulfate said composition containing less than 0.8 mole of free water per mole of ester linkages in said organic surfactant substance.

13. A solid detergent composition in the form of a powder, granules or tablets, consisting essentially of:

a. from 5 to 80 weight percent of organic surfactant substance having the formula $$\left[ RCO \left( \begin{array}{c} R' \\ | \\ OCHCO \end{array} \right)_n O \right]_m M$$

wherein R is saturated or unsaturated straight-chain or branched-chain hydrocarbon having 5 to 19 carbon atoms. with the proviso that more than 70 weight percent of R has from 10 to 14 carbon atoms, R′ is hydrogen, $CH_3$ or $C_2H_5$, $n$ is a number in the range of 1.7 to 6.5 on the average, M is a monovalent or divalent cation, and $m$ is one or 2 depending on the valency of M, b. from 5 to 95 weight percent of water-soluble organic or inorganic salt selected from the group consisting of sodium sulfate, sodium carbonate, sodium bicarbonate, sodium chloride, sodium phosphate, sodium tripolyphosphate, sodium borate, potassium carbonate, magnesium sulfate, calcium chloride, sodium citrate, sodium tartrate, sodium malate, sodium succinate, sodium sulfosuccinate, sodium lactate, sodiium glycolate, potassium citrate, potassium lactate, calcium citrate and calcium lactate, or mixtures thereof, with the proviso that one percent aqueous solutions of said salts have a pH of from 6 to 11, and c. an alkali silicate, said composition containing less than 0.8 mole of free water per mole of ester linkages in said organic surfactant substance.

* * * * *